US009593581B2

(12) United States Patent
Brathwaite

(10) Patent No.: US 9,593,581 B2
(45) Date of Patent: Mar. 14, 2017

(54) COMBINED SEALING AND BALANCING ARRANGEMENT FOR A TURBINE DISC

(75) Inventor: Adrian Brathwaite, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 919 days.

(21) Appl. No.: 13/807,023

(22) PCT Filed: Jun. 15, 2011

(86) PCT No.: PCT/EP2011/059928

§ 371 (c)(1),
(2), (4) Date: Feb. 18, 2013

(87) PCT Pub. No.: WO2012/004094

PCT Pub. Date: Jan. 12, 2012

(65) Prior Publication Data

US 2013/0216383 A1 Aug. 22, 2013

(30) Foreign Application Priority Data

Jul. 5, 2010 (EP) ..... 10168432

(51) Int. Cl.
*F01D 5/02* (2006.01)
*F01D 11/02* (2006.01)

(52) U.S. Cl.
CPC ..... *F01D 5/027* (2013.01); *F01D 11/02* (2013.01); *F05D 2260/96* (2013.01); *Y10T 29/4932* (2015.01)

(58) Field of Classification Search
CPC ..... F01D 5/027; F01D 11/00; F01D 11/001; F01D 11/005; F01D 11/02; F04D 29/08; F04D 29/662; F05D 2260/96
See application file for complete search history.

(56) References Cited

U.S. PATENT DOCUMENTS 430,270 A * 6/1890 Cook ..... F16F 15/363 301/5.21
3,273,419 A * 9/1966 Kollmann ..... F01D 5/027 464/180
3,985,465 A 10/1976 Shuttleworth
4,220,055 A 9/1980 Surdi
4,669,959 A * 6/1987 Kalogeros ..... F01D 5/3015 415/199.5
4,803,893 A * 2/1989 Bachinski ..... F01D 5/027 415/119
4,817,455 A 4/1989 Buxe
(Continued)

FOREIGN PATENT DOCUMENTS

CN 2674106 Y 1/2005
CN 101003849 A 7/2007
(Continued)

*Primary Examiner* — Craig Kim
*Assistant Examiner* — Julian Getachew

(57) ABSTRACT

A turbine disc for a turbine is provided with a first protrusion and a second protrusion. The first protrusion and the second protrusion are formed in such a way that a balancing weight is coupleable between the first protrusion and the second protrusion. The first protrusion has a sealing section that is capable of sealing a fluid passage between the turbine disc and a further turbine part of the turbine.

22 Claims, 3 Drawing Sheets

(56) References Cited

U.S. PATENT DOCUMENTS

| | | | | |
|---|---|---|---|---|
| 4,842,485 | A * | 6/1989 | Barber | F01D 5/027 411/104 |
| 4,926,710 | A | 5/1990 | Novotny | |
| 5,018,943 | A * | 5/1991 | Corsmeier | F01D 5/027 416/144 |
| 5,253,976 | A | 10/1993 | Cunha | |
| 6,481,969 | B2 * | 11/2002 | Berry | F01D 5/027 416/145 |
| 7,491,031 | B2 | 2/2009 | Brault | |
| 2002/0028141 | A1 | 3/2002 | Berry et al. | |
| 2005/0265846 | A1 * | 12/2005 | Przytulski | F01D 5/027 416/144 |
| 2010/0278634 | A1 * | 11/2010 | Koza | F01D 5/027 415/119 |

FOREIGN PATENT DOCUMENTS

| | | | |
|---|---|---|---|
| DE | 2931193 | A1 | 2/1981 |
| EP | 1717481 | A1 | 11/2006 |
| RU | 2018037 | C1 | 8/1994 |

* cited by examiner

COMBINED SEALING AND BALANCING ARRANGEMENT FOR A TURBINE DISC

CROSS REFERENCE TO RELATED APPLICATIONS

This application is the US National Stage of International Application No. PCT/EP2011/059928, filed Jun. 15, 2011 and claims the benefit thereof. The International Application claims the benefits of European application No. 10168432.2 EP filed Jul. 5, 2010. All of the applications are incorporated by reference herein in their entirety.

FIELD OF INVENTION

The present invention relates to a turbine disc for a turbine and to a turbine comprising the turbine disc. Moreover, the present invention relates to a method of producing the turbine disc for the turbine.

ART BACKGROUND

Turbine discs are rotatably mounted to a shaft of a conventional gas turbine. The turbine discs are capable of receiving e.g. the turbine blades. The turbine discs rotate with respect to stationary, non-movable turbine parts, so that the turbine discs need sealing and balancing arrangements in order to provide proper sealing and rotating characteristics.

Between movable parts, such as turbine discs, and stationary parts, such as the output pre-swirling device and the turbine housing a plurality of cavities exists. Between the movable parts and stationary parts a proper sealing is necessary. Therefore, in conventional gas turbines, the leakage reduction from of fluid inside a cavity may be controlled by the use of e.g. a single seal fin arrangement that is arranged at a predetermined location onto the conventional turbine disc.

Moreover, a balancing arrangement for balancing the movable part is necessary. This balancing arrangement may be achieved e.g. by the use of a balancing band at a predetermined location onto the turbine disc, in particular onto the opposite side of the turbine disc, where the single fin arrangement is located.

FIG. 4 shows such a conventional turbine disc arrangement. Onto a first surface of a conventional turbine disc 400 a conventional single sealing lip 401 is arranged and on the opposite side of the conventional turbine disc 400 a conventional balancing arrangement 402 is arranged.

U.S. Pat. No. 4,817,455 discloses a balancing arrangement for a gas turbine engine, wherein a snap ring is placed within a groove in a rotor disc of a rotor. In a spaced location with respect to the snap ring, a sealing arrangement may be attached to the rotor disc.

U.S. Pat. No. 4,926,710 discloses a method of balancing bladed gas turbine engine rotors. A balancing ring is mounted to a rotor disc between a snap ring and a lip of the turbine disc. At a spaced location with respect to the balancing ring, a labyrinth sealing for sealing the rotor disc is arranged.

U.S. Pat. No. 4,220,055 discloses a balancing device for balancing a rotor. Weights, in particular L-shaped weights, are arranged between a first turbine part and a rotatable second rotor part. At a spaced location with respect to the L-shaped weights, a labyrinth sealing arrangement is formed on the rotor disc.

U.S. Pat. No. 7,491,031 B2 discloses a balancing device of a turbo machine engine. To a flange of a turbine disc a sealing disc or a further disc is fixed by a bolt-nut connection. Between the bolt and the nut, a counterweight is attached. At a spaced location of the disc, labyrinth sealing elements may be formed.

In U.S. Pat. No. 3,985,465 a substantially radial outward surface of an axial extension of a compressor disc is used to hold balancing weights. This allows access to the balancing weights by an elongated tool from radially outwards via an access hole. The position of the balancing weights is near a wide passage in the main fluid path between a stator shroud and a rotor blade of the axial flow compressor. The wide passage specifically does not form a seal but may be present to divert fluid from the main fluid path to a secondary air system.

Thus, the sealing arrangement and the balancing arrangement in the conventional arrangement are functionally decoupled and have no interactions between each other.

SUMMARY OF THE INVENTION

It may be an object of the present invention to provide a proper turbine disc which is simple and inexpensive to manufacture.

This object is solved by a turbine disc for a turbine, in particular a gas turbine, by the turbine comprising the turbine disc and by a method of producing the turbine disc for the turbine according to the independent claims.

According to a first aspect of the present invention, a turbine disc for a turbine, in particular a gas turbine, is presented. The turbine disc comprises a first protrusion and a second protrusion. The first protrusion and the second protrusion are formed in such a way that the balancing weight is coupleable between the first protrusion and the second protrusion. Moreover, the first protrusion comprises a sealing section that is capable of sealing and fluid passage between the turbine disc and a further part of the turbine.

According to a further aspect of the present invention, a turbine, in particular a gas turbine, is presented. The turbine comprises a turbine part and the above-described turbine disc. The turbine disc is coupleable to the turbine part in such a way that the sealing section of a first protrusion of the turbine disc seals a fluid passage between the turbine disc and the turbine part.

According to a further aspect of the present invention, a method of producing a turbine disc for a turbine, in particular a gas turbine, is presented. The method comprises the step of forming a first protrusion and a second protrusion onto the turbine disc. The first protrusion and the second protrusion are formed in such a way that a balancing weight is coupleable between the first protrusion and the second protrusion. The first protrusion comprises a sealing section that is capable of sealing a fluid passage between the turbine disc and a further turbine part of the turbine.

The term "protrusion" denotes a flange, a band or an edge that extends substantially in the direction of the normal of a surface of the turbine disc. The protrusion may be formed also by a torus or a flaring, for instance.

The first protrusion and the second protrusion are functionally coupled, because both protrusions realize together the coupling of the balancing weight, wherein one of the protrusions further comprises the sealing section for providing the sealing capability of the turbine disc. Thus, by the functionally coupling of the first protrusion and the second protrusion, a combined sealing and balancing arrangement is presented.

The term "turbine disc" denotes a plate-like shaped disc, which is rotatably connectable to a turbine shaft of the turbine or to an inner face of a turbine housing, for instance. The turbine disc may comprise the turbine blades. The turbine disc may be used as well as compressor disc and is thus mountable in compressors or compressor stages of a turbine.

The term "further part of the turbine" denotes movable and non-movable stationary parts of the turbine or the compressor. A stationary part of the turbine is e.g. the housing of the turbine, the parts of a (outboard) pre-swirling chamber, the combustion chamber or the shaft. Movable parts of the turbine are for instance further adjacent turbine or compressor discs. If the above-described turbine discs and the adjacent located turbine discs provide a relative movement between each other, a proper sealing is necessary.

The term "fluid passage" denotes a passage of the fluid between two cavities inside the turbine. The sealing of the passage is provided by the sealing section of the first protrusion. The sealing section may comprise for instance a sealing lip that is pressed against the further part of the turbine. The sealing section may be integrally formed and monolithic with respect to the first protrusion or may be a separate part with respect to the first protrusion. If the sealing section is a separate part with respect to the first protrusion, the sealing section may be detachably or non-detachably attached to the first protrusion. Thus, the sealing section may comprise a similar material as the first protrusion or may comprise a different material with respect to the first protrusion. For instance, the sealing section may be formed out of material with high sealing properties, such as a wear resistant material or a brush seal, wherein the first protrusion may be formed out of metal or ceramic materials.

The balancing weight is fixable between the first protrusion and the second protrusion e.g. by a press-fit connection or by a separate fixing element, such as a screw or a bolt. The balancing weight is as well fixable between the first protrusion and the second protrusion e.g. by peening, adhesive bonding or welding.

With the above-described turbine disc the sealing and balancing arrangements are functionally coupled and combined. Each of the protrusion, namely the first protrusion and the second protrusion, are used for holding the balancing weight, wherein additionally at least one of the protrusions provides the sealing section. Thus, by the combination of the sealing and balancing arrangement, the installation space that is necessary is reduced, because all functional elements for providing the sealing and the balancing are combined within two protrusions. This results in a simple and inexpensive production method of the turbine disc, because the machine surface onto which the balancing and sealing arrangement is formed or arranged, may be kept very small, so that e.g. a plurality of different and spaced machining surfaces are obsolete. Thus, a readjustment of the turbine disc in the manufacturing device may be obsolete, because only one machining surface has to be machined.

According to a further exemplary embodiment, the turbine disc further comprises a first surface and a second surface, wherein the first protrusion and the second protrusion are formed on at least one of the first surface or second surface.

According to a further exemplary embodiment, the turbine disc is coupleable to the turbine in such a way that the first surface and the second surface are opposed surfaces with respect to an axial direction of a shaft of the turbine. The second surface may be free of a balancing weight arrangement and a further sealing section. The second surface may form a surface of the turbine disc that is directed either upstream and/or downstream of a main fluid flow direction of a turbine. Thus, because the functional elements for the sealing and the balancing of the turbine disc are located onto one surface, the other second surface may be free of any functional elements for sealing or balancing the turbine disc. Thus, the turbine disc is easier to handle, because e.g. the second surface without any functional elements is easier to clamp in a manufacturing device.

According to a further exemplary embodiment, the turbine disc is coupleable to the turbine in such a way, that the first surface is oriented upstream with respect to a fluid flow of the turbine and the second surface is oriented downstream with respect to the fluid flow.

According to a further exemplary embodiment, the sealing section comprises a single seal lip.

According to a further exemplary embodiment, the sealing section comprises a labyrinth seal. By using a labyrinth seal, a plurality of combined sealing lips are used to seal the turbine discs with the further turbine parts.

According to a further exemplary embodiment, the first protrusion and the second protrusion are formed and/or are arranged in such a way, that a recess between the first protrusion and the second protrusion is formed. The recess is formed in such a way that the recess proceeds in a circumferential direction with respect to the shaft of the turbine, when the turbine disc is coupled to the turbine.

The term "recess" denotes the space between a first protrusion and the second protrusion, in which space the balancing weight may be installed. When the first protrusion and the second protrusion form a curved recess between each other, the balancing weight may be coupled to the turbine disc in a desired position along a circumferential direction of the turbine disc with respect to the shaft of the turbine or as well to a rotary axis of the turbine disc. Thus, by slideably attaching the balancing weight inside the recess, a desired balancing position, in which the turbine disc is balanced, may be found for the balancing weight.

Beside the circumferential direction of the recess, the recess may as well proceed linear without having a curved shape. In particular, the recess may as well proceed in a radial direction, in a tangential direction or in any other linear direction with respect to the shaft along the surface of the turbine disc.

The recess is formed by the space between the first protrusion and the second protrusion. The recess may be also defined in such a way that additionally a slot is e.g. milled into the turbine disc.

According to a further exemplary embodiment, the recess is formed in such a way that the recess and the balancing weight are coupleable by a dove tail connection. By providing a dove tail connection, the balancing weight is prevented from being detached from the turbine disc. Simultaneously, the balancing weight is still slideably inside the recess along the first surface of the turbine disc.

The balancing weight may be coupleable in a way that it can be inserted and later clamped, wedged, or fixed into the recess.

According to a further exemplary embodiment, the first protrusion is located at a first position and the second protrusion is located at the second position. A first distance between the first position and the centre of the turbine disc is larger than a second distance between the second position and the centre of the turbine disc.

According to a further exemplary embodiment, the first protrusion and/or the second protrusion are detachably mounted onto the turbine disc. Thus, the maintenance of the turbine disc may be improved, because damaged first protrusions or second protrusions may be simply exchanged, so that it is not longer necessary to exchange the whole turbine disc. Thus, maintenance costs are reduced.

According to a further exemplary embodiment, the first protrusion and the second protrusion are integrally formed (monolithically) with the turbine disc. Thus, the manufacturing method may be easier because the turbine disc as well as the first protrusion and the second protrusion may be formed in one production step, e.g. by casting or milling. Further operation steps for fixing the first protrusion or the second protrusion may not be necessary.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
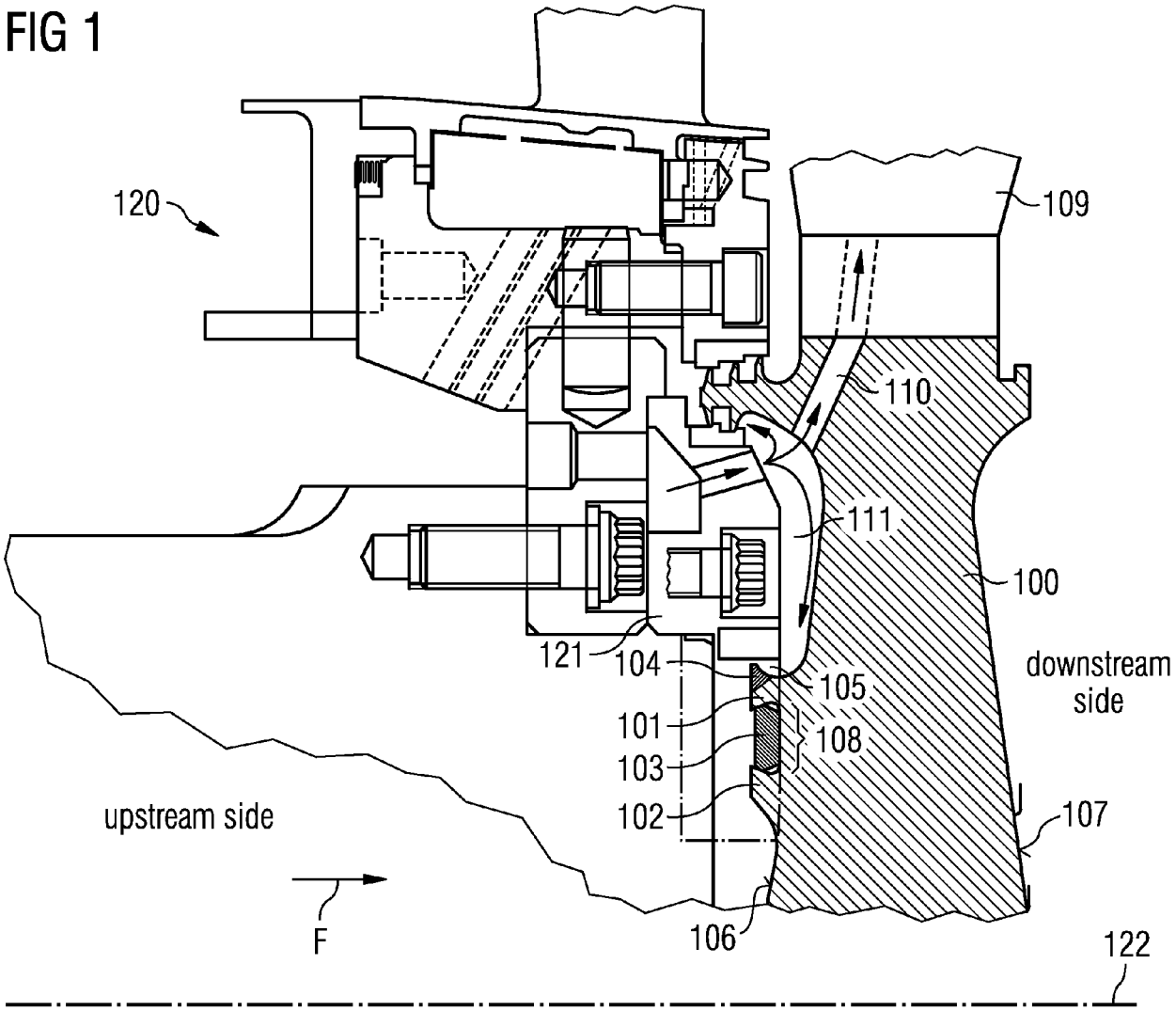
FIG. 1 shows a turbine with a turbine disc according to an exemplary embodiment of the present invention.

The illustrations in the drawings are schematical. It is noted that in different figures, similar or identical elements are provided with the same reference signs.

FIG. 1 shows a turbine disc 100 for a turbine 120 according to an exemplary embodiment of the invention. The turbine 120 is in particular a gas turbine. The turbine disc 100 comprises a first protrusion 101 and a second protrusion 102. The first protrusion 101 and the second protrusion 102 are formed in such a way that a balancing weight 103 is coupleable between the first protrusion 101 and the second protrusion 102. The first protrusion 101 comprises a sealing section 104 that is capable of sealing a fluid passage 105 between the turbine disc 100 and a further part of the turbine 120.

Figure 4:
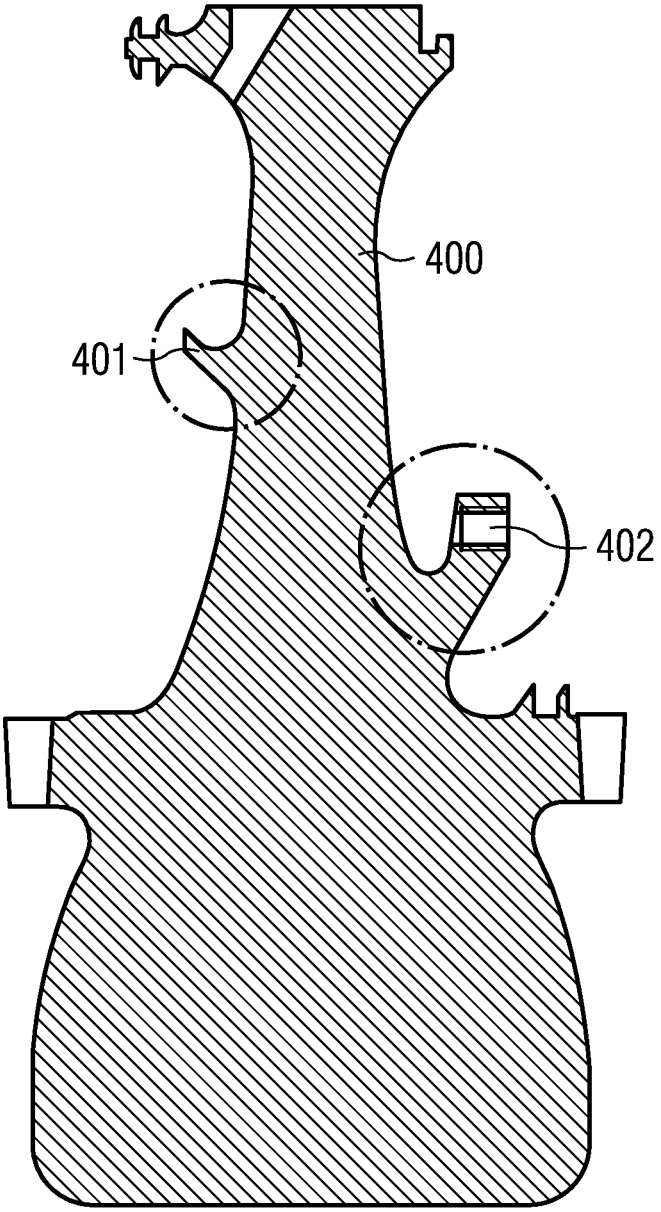
FIG 4 (PRIOR ART)
FIG. 4 shows a conventional turbine disc.

The sealing section 104 may be positioned and arranged to have a similar sealing effect as the conventional single sealing lip 401 as shown in FIG. 4. The sealing section 104 may preferably be still formed as a lip or a fin.

The further turbine part 121 of the turbine 120 is for instance the housing of the turbine 120 or a further turbine disc that is located adjacent to the described turbine disc 100. In particular, the turbine part 121 shown in FIG. 1 is a swirling chamber. The further turbine part 121 is particularly not components of the main fluid path but components radial inwards of the main fluid path, particularly surfaces of the turbine discs.

As shown in FIG. 1, cooling air is blown out by the swirling chamber 121 inside a cavity 111 between the swirling chamber 121 and the turbine disc 100. The cooling air is intended to flow through a cooling air duct 110 of the turbine disc 100 in order to flow inside a blade 109 for cooling the blade 109. The cooling fluid that flows inside the cavity 111 along a first surface 106 of the turbine disc 100 cools the turbine disc 100. In order to prevent the cooling fluid from streaming to the upstream side of the turbine 120, i.e. escaping from the cavity 111, the sealing section 104 of the first protrusion 101 seals the inner cavity 111.

According to the Figure, the sealing section 104 is located radially inwards of the cooling air duct 110. The cavity 111 is delimited radially inwards via the sealing section 104 and radially outwards by a further seal.

As shown in FIG. 1, the first surface 106 of the turbine disc 100 is directed to the upstream side of the fluid flow of the turbine 120. In general, each turbine 120 comprises a main fluid flow direction F from the upstream side to the downstream side, wherein with respect to the turbine disc 100 of the present invention, the turbine disc 100 divides the upstream side from the downstream side. The cooling air flow may on the other hand have a flow direction equal or opposite that of the main fluid flow, i.e. from the right to the left as shown in FIG. 1. This may particularly be the case for downstream turbine stages, in which case the balancing and sealing arrangement preferably is located on the downstream side of the turbine disc. The sealing section 104 seals the fluid passage 105 between the inner cavity 111 and the upstream side, so that a leakage of cooling fluid through the fluid passage 105 is reduced.

As shown in FIG. 1, the first protrusion 101 and the second protrusion 102 are formed or arranged to the first surface 106 of the turbine disc 100, wherein the first surface 106 is aligned to the upstream side of the turbine 120. Between the first protrusion 101 and the second protrusion 102 the balancing weight 103 is attachable, so that the combined arrangement of the first protrusion 101 and the second protrusion 102 form a balancing arrangement. Moreover, the first protrusion 101 comprises the sealing arrangement 104, such as a sealing lip or a labyrinth sealing, so that the combination of the first protrusion and the second protrusion presents a sealing arrangement and a balancing arrangement.

Between the first protrusion 101 and the second protrusion 102, a recess 108 is formed in which the balancing weight 103 is attachable, in particular slideably attachable.

A final fixation of the weight element 103 may be established by a removable fixing element, such as a screw or a bolt, or by a permanent fixing element such as a welding point or a press-fit connection. Prefably the balancing weights will be peened into place to make it semi-permanent.

Figure 2:
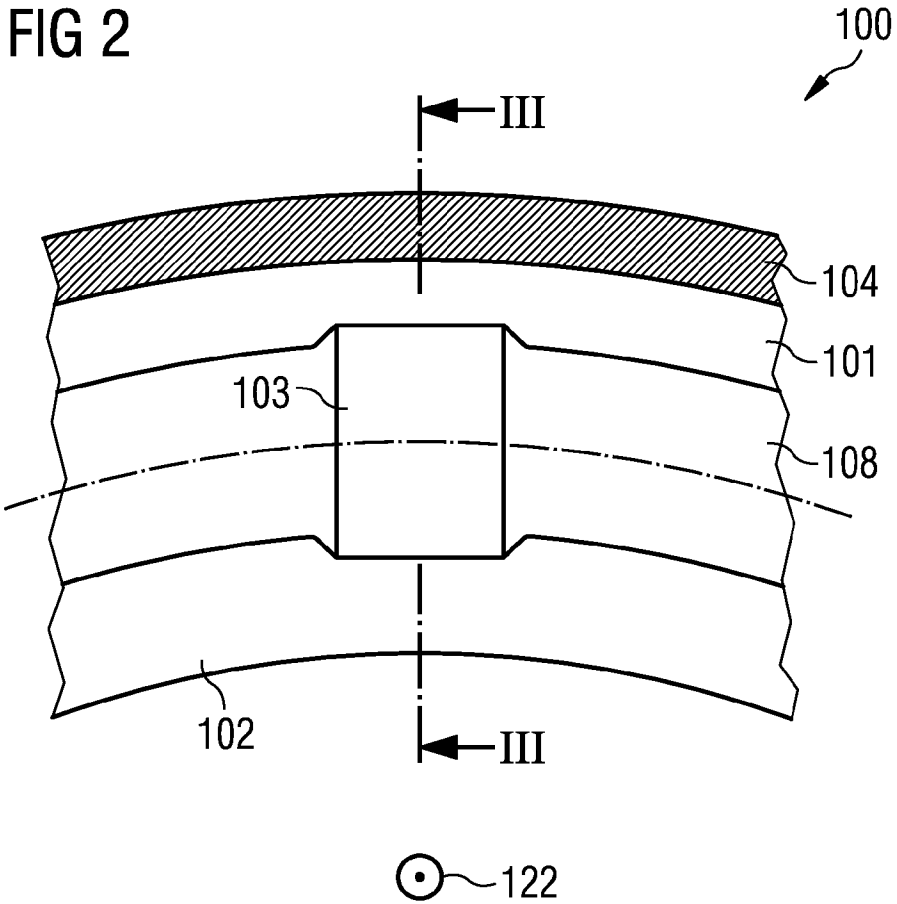
FIG. 2 shows a detailed view of an exemplary embodiment of the turbine disc according to an exemplary embodiment of the present invention.

FIG. 2 shows a more detailed view of a turbine disc 100 according to an exemplary embodiment of the present invention. The balancing weight 103 is attached between the first protrusion 101 and the second protrusion 102. As indicated in FIG. 2, the first protrusion 101 and the second protrusion 102 form a recess 108 between each other. The recess 108 extends along a curved line (indicated by the dotted line)—particularly a circular line—around a shaft 122 or a rotational axis of the turbine disc 100. Thus, the balancing weight 103 may be moved or placed inside the recess 108 in the circumferential direction around the shaft 122.

The balancing weight 103 may be finally fixed by peening as shown in FIG. 2. It is shown that the weight element 103 is hammered inside the recess 108, because the recess 108 is smaller in its width than the balancing weight 103, so that a press-fit connection is achieved. Other fixing means, such as screw fitting or bolt fitting, is applicable as well.

Moreover, it is shown, that the first protrusion 101 comprises the sealing section 104, which may present a sealing lip for instance.

Figure 3:
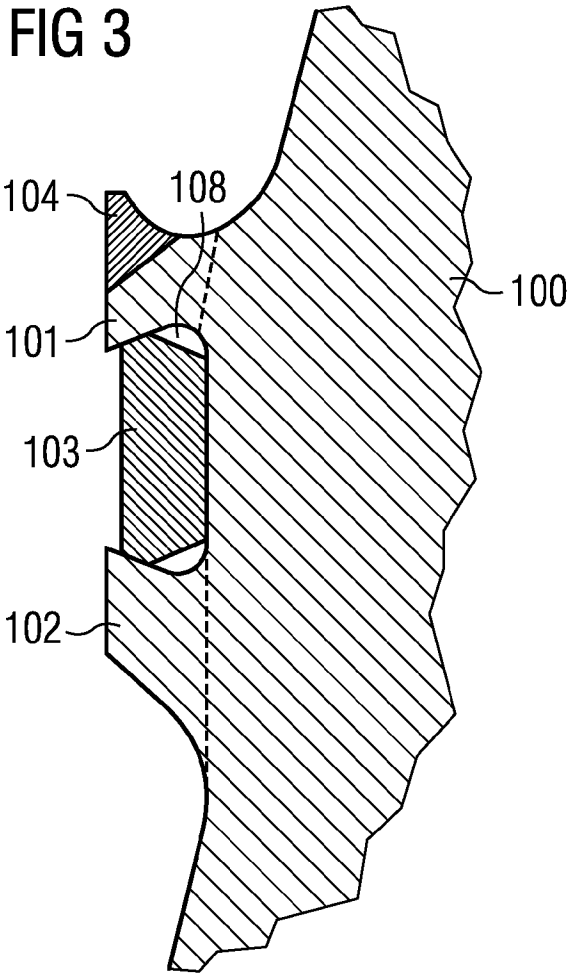
FIG. 3 shows a sectional view III-III of the exemplary embodiment of the turbine disc as shown in FIG. 2.

FIG. 3 shows a sectional view III-III of FIG. 2. The first protrusion 101 comprises the sealing section 104 that is formed with a sealing lip. Moreover, the inner profile of the recess 108, which is formed by the first protrusion 101 and the second protrusion 102, forms a dove tail shaped hollow profile. Inside this dove tail shaped hollow profile, the balancing weight 103 with a corresponding (dove tail shaped) profile may be installed.

As indicated by the dotted line in FIG. 3, the first protrusion 101 and the second protrusion 102 may be integrally formed with the turbine disc 100 or may be alternatively detachably arranged at the turbine disc 100. Also the sealing section 104 may be integrally formed with the first protrusion 101 or may be alternatively detachably arranged at the first protrusion 101. Preferably the sealing section 104 and the first protrusion 101 for a circular surface projecting from a side face of the turbine disc 100. Preferably the combined sealing section 104 and the first protrusion 101 is situated on an axial plane. Also the balancing weights will preferably arranged on an axial plane. Thus the balacing weights will be inserted from an axial direction to the turbine disc 100.

The sealing section 104 may particularly be located on a side face of a turbine disc 100, i.e. a face directed in upstream direction or possibly a face directed in downstream direction. Furthermore the sealing section 104 may form a lip to form a narrow passage with an opposing non-rotating surface. This narrow passage will allow to pass a small amount of secondary cooling air that has not entered the cooling air duct 110. Preferably the narrow passage forms a seal for the cavity 111.

According to the invention the sealing section 104 may form one rim for holding the balancing weights.

Preferably the first protrusion 101 and a second protrusion 102 form concentric circular protrusions.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A turbine disc for a turbine, comprising a first protrusion and a second protrusion extending in radially spaced apart positions that form a recess positioned in a radial direction between the first and second protrusions with respect to a shaft of the turbine, when the turbine disc is coupled to the shaft of the turbine, wherein the first protrusion and the second protrusion are formed in such a way that a balancing weight is coupleable in the recess between and directly to the first protrusion and the second protrusion, and wherein the first protrusion comprises a sealing section that is capable of sealing a fluid passage between the turbine disc and a further turbine part of the turbine, wherein the sealing section comprises at least one sealing lip.

2. The turbine disc of claim 1, further comprising a first surface and a second surface, wherein the first protrusion and the second protrusion are formed on at least one of the first surface or second surface.

3. The turbine disc of claim 2, wherein the turbine disc is coupleable to the turbine in such a way that the first surface and the second surface are opposed surfaces in an axial direction of a shaft of the turbine.

4. The turbine disc of claim 3, wherein the turbine disc is coupleable to the turbine in such a way that the first surface is orientated upstream with respect to a fluid flow of the turbine and the second surface is orientated downstream with respect to the fluid flow.

5. The turbine disc of claim 1, wherein the sealing section comprises a labyrinth seal.

6. The turbine disc of claim 1, wherein the recess is formed in such a way that the recess proceeds in a circumferential direction with respect to the shaft of the turbine, when the turbine disc is coupled to the turbine.

7. The turbine disc of claim 6, wherein the recess is formed in such a way that the recess and the balancing weight are coupleable by a dovetail connection.

8. The turbine disc of claim 1, wherein the first protrusion is located at a first position and the second protrusion is located at a second position, wherein a first distance between the first position and a centre of the turbine disc is larger than a second distance between the second position and the centre of the turbine disc.

9. The turbine disc of claim 1, wherein the first protrusion and the second protrusion are detachably mounted on the turbine disc.

10. The turbine disc of claim 1, wherein the first protrusion and the second protrusion are integrally formed with the turbine disc.

11. The turbine disc of claim 2, wherein the second surface is free of a balancing weight arrangement and a further sealing section.

12. A turbine, comprising:

the shaft, the further turbine part, and the turbine disc according to claim 1, the balancing weight mounted inside the recess, wherein the turbine disc is mounted to the shaft and is rotatable with the shaft such that the first protrusion and the second protrusion extend in the radially spaced apart positions with respect to the shaft, wherein the turbine disc is coupleable to the further turbine part in such a way that the sealing section of the first protrusion of the turbine disc seals the fluid passage between the turbine disc and the further turbine part.

13. The turbine of claim 12, wherein the turbine is a gas turbine.

14. A method of producing a turbine disc for a turbine, the method comprising:

forming a first protrusion and a second protrusion onto the turbine disc, which extend in radially spaced apart positions that form a recess positioned in a radial direction between the first and second protrusions with respect to a shaft of the turbine, when the turbine disc is coupled to the shaft of the turbine, wherein the first protrusion and the second protrusion are formed in such a way that a balancing weight is coupleable in the recess between and directly to the first protrusion and the second protrusion, and wherein the first protrusion comprises a sealing section that is capable of sealing a fluid passage between the turbine disc and a further turbine part of the turbine, wherein the sealing section comprises at least one sealing lip.

15. The method of claim 14, further comprising, peening the balancing weight into place inside the recess.

16. The turbine of claim 12, wherein the balancing weight is peened into place inside the recess.

17. The turbine of claim 1, wherein the sealing section is located radially inwards of a cooling air duct.

18. The turbine of claim 1, wherein the at least one sealing lip is pressed against the further part of the turbine.

19. The turbine of claim 18, wherein the sealing section comprises a labyrinth seal.

20. The method of claim 14, wherein the sealing section is located radially inwards of a cooling air duct.

21. The method of claim 14, wherein the at least one sealing lip is pressed against the further part of the turbine.

22. The method of claim 21, wherein the sealing section comprises a labyrinth seal.

* * * * *